US008292162B2

(12) United States Patent
Heyman

(10) Patent No.: US 8,292,162 B2
(45) Date of Patent: Oct. 23, 2012

(54) ENVELOPE

(75) Inventor: Marc Heyman, Finksburg, MD (US)

(73) Assignee: OMG Enterprises, LLC, Los Angeles, CA (US)

( * ) Notice: Subject to any disclaimer, the term of this patent is extended or adjusted under 35 U.S.C. 154(b) by 797 days.

(21) Appl. No.: 11/469,276

(22) Filed: Aug. 31, 2006

(65) Prior Publication Data

US 2008/0061119 A1 Mar. 13, 2008

(51) Int. Cl.
*B65D 27/14* (2006.01)

(52) U.S. Cl. ..... 229/80

(58) Field of Classification Search ..... 229/80
See application file for complete search history.

(56) References Cited

U.S. PATENT DOCUMENTS 282,920 A * 8/1883 Plimpton ..... 229/80
1,768,836 A * 7/1930 Gjorup ..... 229/80
2,804,395 A 8/1957 Boyajian
3,200,094 A * 8/1965 Sederlund et al. ..... 524/25
4,575,525 A * 3/1986 Wacome et al. ..... 524/48
4,719,264 A * 1/1988 Lotz, Jr. ..... 525/203
4,738,865 A 4/1988 Morris
2004/0134977 A1 7/2004 O'Dwyer et al.
2005/0230459 A1 10/2005 Johnson et al.

FOREIGN PATENT DOCUMENTS

DE 29821484 U1 * 2/1999

* cited by examiner

*Primary Examiner* — Jes F Pascua
(74) *Attorney, Agent, or Firm* — James A. Italia; Italia IP

(57) ABSTRACT

An envelope according to the present invention includes an envelope body having a first end and defining an interior area selectively accessible adjacent the first end through which articles may be inserted. The envelope includes a flap extending from the first end that is selectively movable between first and second configurations in which the interior area is accessible or enclosed, respectively. Further, the envelope includes adhesive situated on the flap for interacting with the envelope body to maintain the flap at the second configuration. In addition, flavoring is disposed the flap, but at a position that is adjacent to and distinct from the adhesive. The envelope may include first and second indicia on the flap, with one indicia including only adhesive and with the other indicia including only flavoring. The indicia may present geometric shapes, or alphanumeric data such as an advertisement or other messages.

14 Claims, 4 Drawing Sheets

ENVELOPE

BACKGROUND OF THE INVENTION

This invention relates generally to envelopes and, more particularly, to an envelope having adhesive and flavoring arranged in distinct areas on the flap of an envelope.

Mailing letters is usually a positive experience except for enduring the unpleasant taste when licking the adhesive along the edge of the envelope flap in order to seal it to the envelope body. Having an envelope with a more acceptable flavor to mask the adhesive would definitely be desirable.

Various products and patents have been proposed in the art for addressing the traditionally foul taste of adhesive on an envelope flap. Although assumably effective for their intended purposes, the existing products and proposals provide a mixture or combined solution of adhesive and flavoring agent, with the flavoring agent being provided in such a quantity or proportion to dominant the taste of the adhesive. This combination of flavoring and adhesive, unfortunately, may result in the use of excessive quantities of both the flavoring agent and adhesive or may limit use of potential flavoring agents or adhesives that are not complementary or conducive to being combined.

Therefore, it would be desirable to have an envelope having a flavoring and adhesive situated on an envelope flap, the flavoring and adhesive being arranged separately and distinctly from one another. Further, it would be desirable to have an envelope in which both the adhesive and flavoring are moisture activated and in which the flavoring contributes to sealing the flap to the envelope body. In addition, it would be desirable to have an envelope in which a flavoring may be arranged as alphanumeric or shape indicia, whereby to communicate advertising, seasonal or holiday greetings, or other messages.

SUMMARY OF THE INVENTION

Therefore, an envelope according to the present invention includes an envelope body having a first end and defining an interior area selectively accessible adjacent the first end. This interior area corresponds to the opening typical of a standard envelope through which articles such as letters and the like may be inserted. The envelope includes a flap extending from the first end that is selectively movable between a first configuration in which the interior area is accessible and a second configuration in which the interior area is enclosed. Further, the envelope includes adhesive situated on the flap for interacting with the envelope body to maintain the flap at the second configuration. In addition, flavoring is disposed the flap, but at a position that is adjacent to and distinct from the adhesive. The envelope may include first and second indicia on the flap, with one indicia including only adhesive and with the other indicia including only flavoring. The indicia may present geometric shapes, or alphanumeric data such as an advertisement or message.

Therefore, a general object of this invention is to provide an envelope having both adhesive and flavoring on an envelope flap so that the taste of the adhesive is masked by the taste of the flavoring when the envelope flap is licked by a person.

Another object of this invention is to provide an envelope, as aforesaid, in which the flavoring and adhesive are situated in distinct areas along the envelope flap for minimizing the amount of flavoring and adhesive applied to the flap.

Still another object of this invention is to provide an envelope, as aforesaid, in which the flavoring is a moisture activated sugar based substance that contributes to the adhesive effect.

Yet another object of this invention is to provide an envelope, as aforesaid, in which the flavoring may be presented in various shapes, patterns, colors, or even alphanumeric combinations that communicate seasonal, holiday, special occasion, advertising, or other messages.

A further object of this invention is to provide an envelope, as aforesaid, in which the flavoring and adhesive are only minimally mixed when moistened by a user's tongue such that complementary chemical combinations thereof are unnecessary.

A still further object of this invention is to provide an envelope, as aforesaid, in which the adhesive and flavoring may present different colors.

Another object of this invention is to provide an envelope, as aforesaid, having that includes a second flavoring on the envelope flap that is adjacent but distinct from the adhesive and first-mentioned flavoring.

Still another object of this invention is to provide an envelope, as aforesaid, which is economical to manufacture in that less quantity of adhesive and flavoring is necessary.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
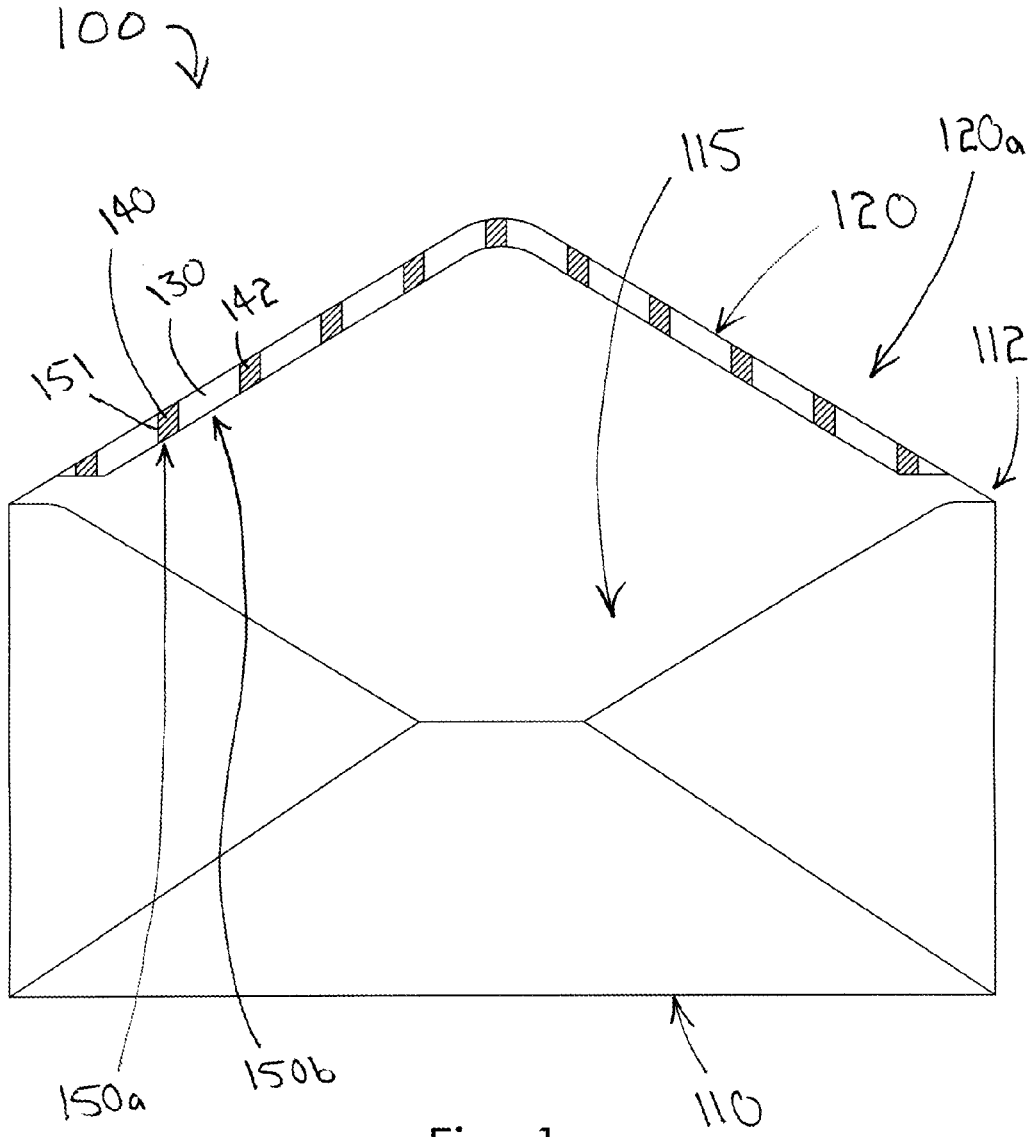
FIG. 1 is a front view of an envelope according to a preferred embodiment of the present invention with the adhesive and flavoring in one arrangement.
Figure 2:
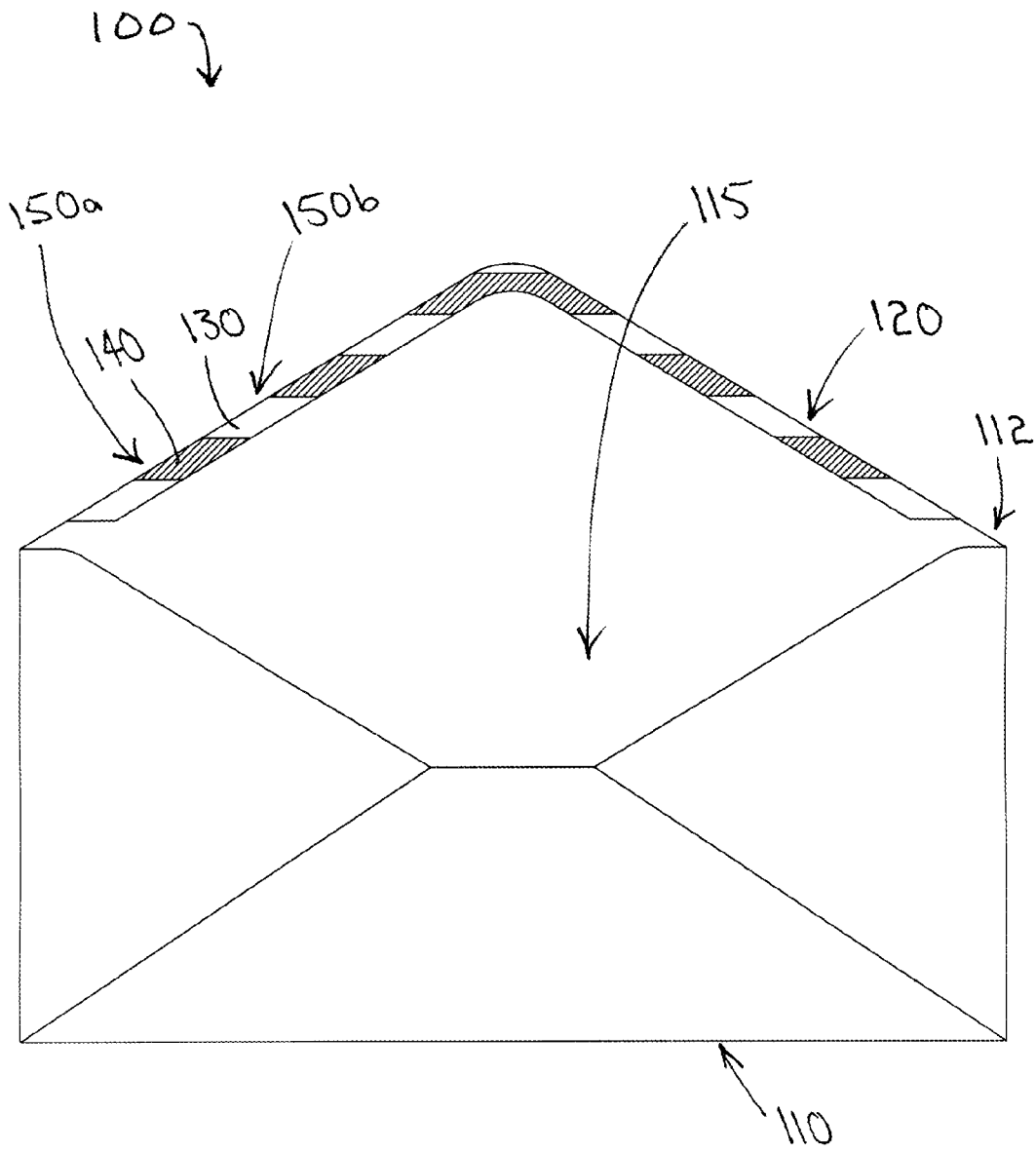
FIG. 2 is another front view of the envelope as in FIG. 1 with the adhesive and flavoring in another arrangement.
Figure 3:
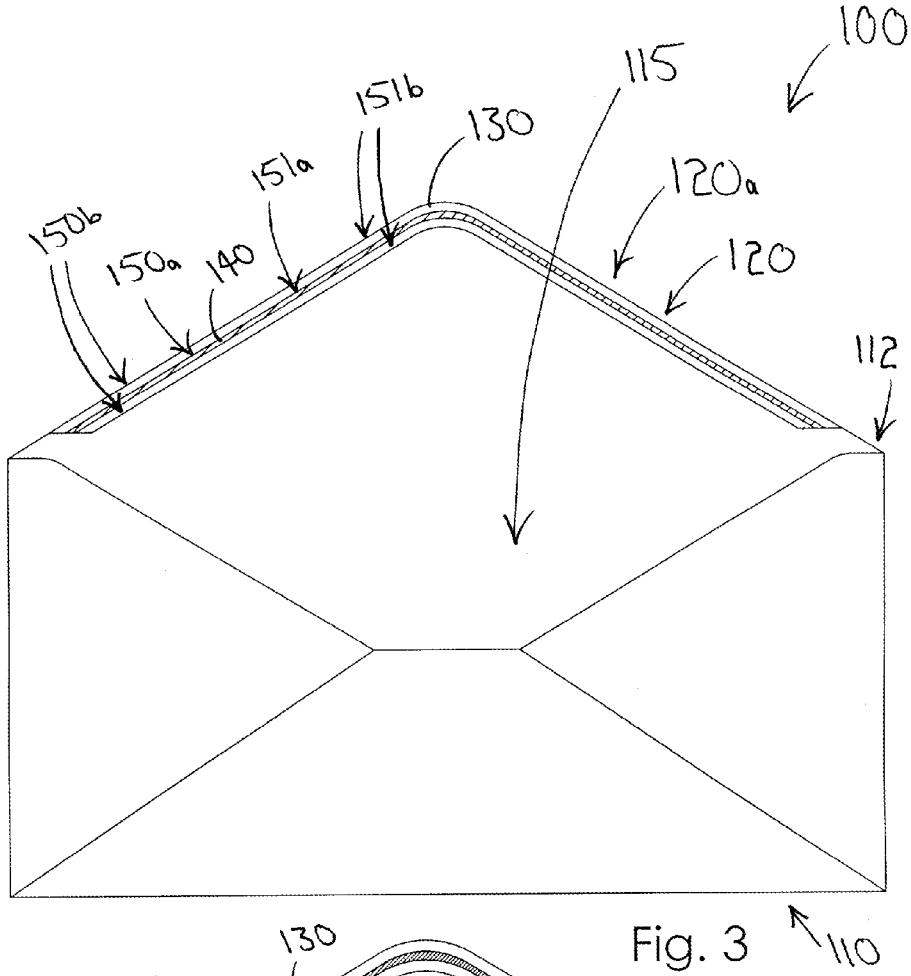
FIG. 3 is another front view of the envelope as in FIG. 1 with the adhesive and flavoring in yet another arrangement, the flavoring shown in an un-moistened condition.
Figure 4:
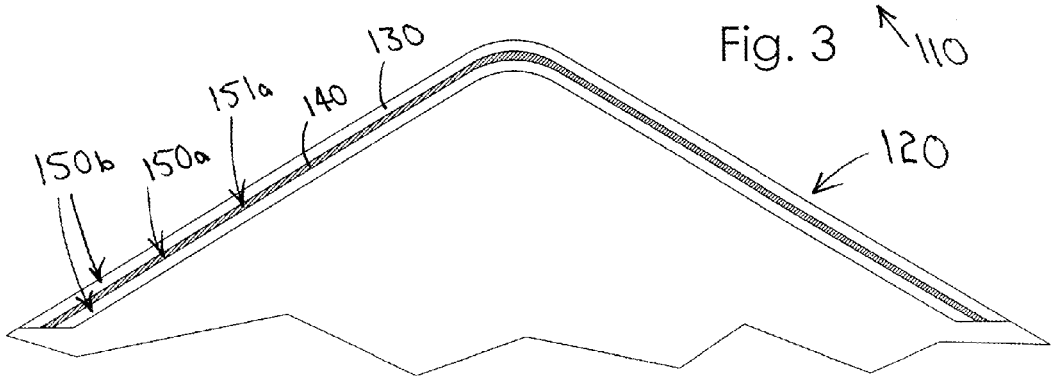
FIG. 4 is a fragmentary view of the envelope flap as in FIG. 3, shown in a moistened condition.

An envelope 100 according to the present invention will now be described in detail with reference to FIGS. 1 through 5*c* of the accompanying drawings. More particularly, an envelope 100 according to the current invention includes an envelope body 110, a flap 120, adhesive 130, and flavoring 140.

As shown in FIG. 1, the envelope body 110 has a first end 112 and defines an interior area 115 that is selectively accessible adjacent the first end 112. The envelope body 110 may be substantially flat (a front side 110*a* of the envelope body 110 may be substantially adjacent a rear side 110*b* of the envelope body 110) and define a relatively narrow interior area 115 or may be deep (the front side 110*a* may be spaced apart from the rear side 110*b*) and define a relatively spacious interior area 115, as is known in the art. The envelope body 110 may be constructed from paper, cardboard, or another appropriate material.

The flap 120 extends from the first end 112 of the envelope body 110 and is selectively movable between a first configuration 120*a* (FIGS. 1 through 3) in which the interior area 115 is accessible and a second configuration (not shown) in which the interior area 115 is enclosed. The flap 120 may be of unitary construction with the envelope body 110 as shown throughout the drawings, or the flap 120 may be constructed separately and attached to the envelope body 110. This construction enables articles such as letters to be inserted into the interior area when the flap is in the first configuration.

The adhesive 130 is on the flap 120 to interact with the envelope body 110 and maintain the flap 120 at the second configuration, so that the envelope 100 may be mailed, for example. The flavoring 140 is situated on the flap 120 adjacent and distinct from the adhesive 130. In other words, the flavoring 140 is not mixed with the adhesive 130, and neither the flavoring 140 nor the adhesive 130 acts as a substrate for the adhesive 130 or the flavoring 140, respectively. The adhesive 130 may be a moisture activated adhesive, such as dextrin or polyvinyl alcohol for example, and the flavoring 140 may be a moisture activated flavoring, such as sugar, for example. The adhesive 130 may be one color, and the flavoring 140 may be another color to distinguish the adhesive 130 from the flavoring 140, and the color of the flavoring 140 may correspond to the flavoring. For example, a strawberry flavored flavoring 140 may have a red color, while a mint flavored flavoring 140 may have a green color. It is also understood that the sugar flavoring may also act as another adhesive when activated by moisture.

Figure 5A:
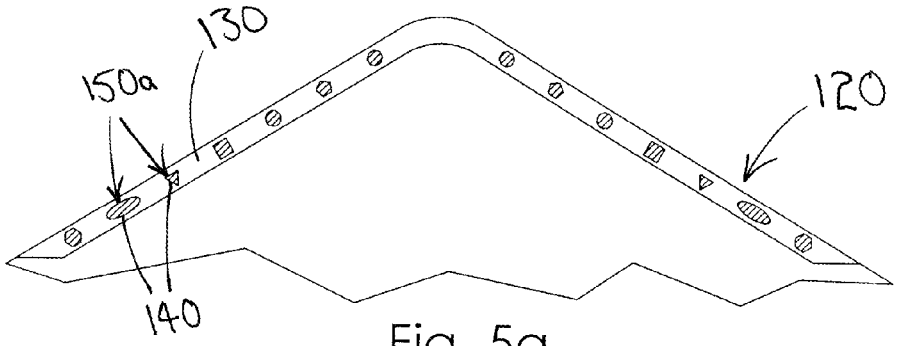
FIG. 5*a* is a fragmentary view of the envelope flap in which the first indicia includes geometric shapes.
Figure 5B:
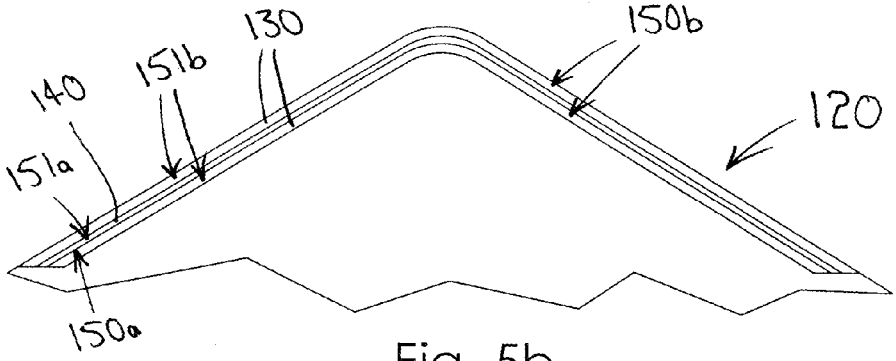
FIG. 5*b* is a fragmentary view of the envelope flap in which the a flavoring line is sandwiched between a pair of adhesive lines.
Figure 5C:
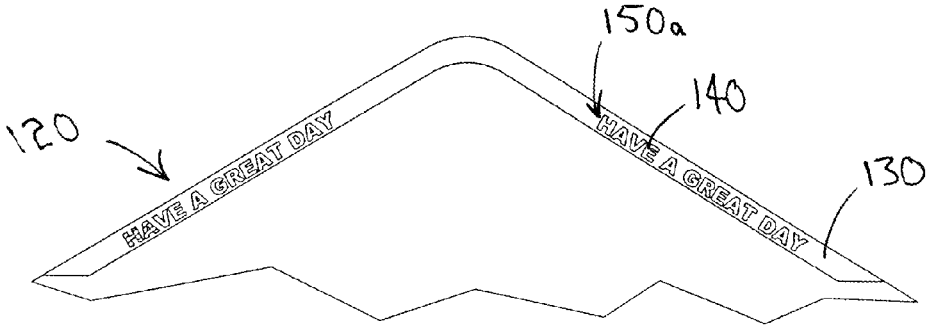
FIG. 5*c* is a fragmentary view of the envelope flap in which the first indicia includes alphanumeric symbols.

Indicia may be included on the flap 120 in various manners. FIGS. 1 through 4 and 5*b* show that first and second indicia 150*a*, 150*b* may include geometric shapes 151 (e.g., stripes, waves, zigzags, etc.). The first indicia 150*a* may include the flavoring 140, and the second indicia 150*b* may include the adhesive 130, or vice versa. However, the first indicia 150*a* preferably does not include both the flavoring 140 and the adhesive 130, and the second indicia 150*b* preferably does not include both the flavoring 140 and the adhesive 130. Returning to the examples shown in FIGS. 3, 4, and 5*b*, the first indicia 150*a* may include the flavoring 140 and define a flavoring line 151*a*, and the second indicia 150*b* may include the adhesive 130 and define a pair of adhesive lines 151*b* sandwiching the flavoring line 151*a*. Alternately, as shown in FIGS. 5*a* and 5*c*, the first indicia 150*a* may include symbols (FIG. 5*a*) or alphanumeric data (FIG. 5*c*). If the first indicia 150*a* includes the flavoring 140, the first indicia 150*a* may be surrounded by the adhesive 130; if the first indicia 150*a* includes the adhesive 130, the first indicia 150*a* may be surrounded by the flavoring 140. The alphanumeric data may include an advertisement, a greeting (FIG. 5*c*), or a reminder, for example. Additional examples of symbols include hearts, Christmas trees, and wedding bells.

As shown in FIG. 1, a second flavoring 142 may be included on the flap 120. The second flavoring 142 may be distinct from the adhesive 130 and the first flavoring 140, and the second flavoring 142 may be adjacent the adhesive 130 and/or the first flavoring 140. The first and second flavorings 140, 142 may alternate as shown, or various regions may include the respective flavorings 140, 142.

In use, the adhesive 130 and the flavoring 140 may be placed on the flap 120 in configurations as set forth above. The manufacturing process of placing the adhesive 130 and the flavoring 140 on the flap 120 may be both simple and effective due to the separation of the adhesive 130 and the flavoring 140, even if intricate indicia is used. To seal the interior area 115, then, the adhesive 130 and flavoring 140 may be licked and the flap 120 may be folded to the second configuration. The user may enjoy licking the flap 120 due to the flavoring 140 and/or the indicia, and the flavoring 140 and/or the indicia may reinforce or increase the user's pleasure associated with an event. For example, licking indicia that includes Christmas tree shapes and candy cane flavoring 140 may increase the user's anticipation for Christmas or the user's enjoyment of the Christmas season. The provider of the envelope 100 may benefit from providing advertising or a reminder as set forth above.

It is understood that while certain forms of this invention have been illustrated and described, it is not limited thereto except insofar as such limitations are included in the following claims and allowable functional equivalents thereof.

What is claimed is as follows:

1. An envelope, comprising:

an envelope body having a first end and defining an interior area selectively accessible adjacent said first end;

a flap extending from said first end of said envelope body, said flap being selectively movable between a first configuration in which said interior area is accessible and a second configuration in which said interior area is enclosed;

adhesive on said flap to interact with said envelope body and maintain said flap at said second configuration;

flavoring on said flap, said flavoring being adjacent and distinct from said adhesive;

first indicia and second indicia on said flap, said first indicia including said flavoring, said second indicia including said adhesive;

wherein:

said first indicia does not include said adhesive; and said second indicia does not include said flavoring.

2. The envelope as in claim 1, wherein said first indicia includes geometric shapes and said second indicia includes geometric shapes.

3. The envelope as in claim 1, wherein said indicia includes alphanumeric data.

4. The envelope as in claim 3, wherein said alphanumeric data includes an advertisement.

5. The envelope as in claim 3, wherein said alphanumeric data includes a greeting.

6. The envelope as in claim 1, wherein:

said adhesive is a moisture activated adhesive; and said flavoring is a moisture activated flavoring.

7. The envelope as in claim 1, further comprising a second flavoring on said flap, said second flavoring being distinct from said adhesive and said flavoring.

8. The envelope as in claim 7, wherein said second flavoring is adjacent at least one item selected from the group consisting of said adhesive and said flavoring.

9. The envelope as in claim 1, wherein said adhesive is a first color and said flavoring is a second color.

10. An envelope, comprising:

an envelope body having a first end and defining an interior area selectively accessible adjacent said first end;

a flap extending from said first end of said envelope body, said flap being selectively movable between a first configuration in which said interior area is accessible and a second configuration in which said interior area is enclosed;

adhesive on said flap to interact with said envelope body and maintain said flap at said second configuration;

flavoring on said flap, said flavoring being adjacent and distinct from said adhesive, said flavoring being one color and said adhesive being another color;

wherein:

said flavoring defines a flavoring line; and said adhesive defines a pair of adhesive lines sandwiching said flavoring line.

11. The envelope as in claim 10, wherein:

said adhesive defines at least one geometric shape; and said flavoring defines at least one geometric shape.

12. The envelope as in claim 10, further comprising first indicia and second indicia on said flap, said first indicia including said flavoring, said second indicia including said adhesive.

13. The envelope as in claim 10, further comprising indicia on said flap, said indicia including one item selected from the group consisting of said flavoring and said adhesive, said indicia including at least one item selected from the group consisting of alphanumeric data, a geometric shape, and a symbol.

14. The envelope as in claim 10, wherein:

said adhesive is a moisture activated adhesive; and said flavoring is a moisture activated flavoring.

* * * * *